US008002155B2

(12) United States Patent
Mitsui et al.

(10) Patent No.: US 8,002,155 B2
(45) Date of Patent: Aug. 23, 2011

(54) SLIDE VALVE DEVICE FOR AUTOMATIC SURFACE PRESSURE APPLICATION

(75) Inventors: Kenji Mitsui, Tokyo (JP); Mototsugu Osada, Tokyo (JP); Hiroaki Morii, Tokyo (JP)

(73) Assignee: Shinagawa Refractories Co., Ltd., Tokyo (JP)

( * ) Notice: Subject to any disclaimer, the term of this patent is extended or adjusted under 35 U.S.C. 154(b) by 420 days.

(21) Appl. No.: 12/227,941

(22) PCT Filed: Jun. 4, 2007

(86) PCT No.: PCT/JP2007/061272

§ 371 (c)(1),
(2), (4) Date: Dec. 3, 2008

(87) PCT Pub. No.: WO2007/142178

PCT Pub. Date: Dec. 13, 2007

(65) Prior Publication Data

US 2009/0184139 A1 Jul. 23, 2009

(30) Foreign Application Priority Data

Jun. 7, 2006 (JP) ..... 2006-158356

(51) Int. Cl.
*B67D 3/02* (2006.01)

(52) U.S. Cl. ..... 222/606; 222/600; 222/601; 266/236

(58) Field of Classification Search ..... 222/600, 222/601, 606; 266/236
See application file for complete search history.

(56) References Cited

U.S. PATENT DOCUMENTS 7,258,256 B2 * 8/2007 Mitsui et al. ..... 222/600

FOREIGN PATENT DOCUMENTS

JP 2006-136912 6/2006
WO 2006/051753 5/2006

OTHER PUBLICATIONS

International Search Report issued Sep. 4, 2007 in the International (PCT) Application of which the present application is the U.S. National Stage.

* cited by examiner

*Primary Examiner* — Roy King
*Assistant Examiner* — Lois Zheng
(74) *Attorney, Agent, or Firm* — Wenderoth, Lind & Ponack, L.L.P.

(57) ABSTRACT

A slide valve device for automatic surface pressure application including a slide valve having a three-layer structure, in which the movable bodies of the seal case is slidable on a support surface of a spring holder. The slide case and the seal case are coupled with each other by means of a coupling device or a coupling stopper, and the cases are slid together by means of an actuator so as to apply and release a surface pressure.

8 Claims, 13 Drawing Sheets

SLIDE VALVE DEVICE FOR AUTOMATIC SURFACE PRESSURE APPLICATION

BACKGROUND OF THE INVENTION

1. Technical Field

The present invention relates to a slide valve device for automatic surface pressure application, and more particularly, to a novel improvement for eliminating heavy physical work conducted under high temperature, stabilizing a surface pressure application force, and achieving compactification in a slide valve device constituted by a fixed plate, a slide plate, and a seal plate.

2. Description of the Related Art

Generally, the continuous casting facilities are provided with, as means for controlling outflow of a molten metal from a molten metal vessel, a slide valve device provided at a bottom portion of the molten metal vessel, for opening and closing an outflow port.

Examples of structures of the slide valve device include a toggle mechanism in which a surface pressure is manually applied and released. Further, as another example, there may be given a slide valve device having a two-layer structure (Japanese Patent Application No. 2004-327405), which is manufactured by the applicants of the present invention as illustrated in FIG. 12. That is, a fixed plate 3 is incorporated in a base frame 2 fixed to a bottom portion of a molten metal vessel 1, and a slide plate 5 and a shooting nozzle 6 are supported in a slide case 4 positioned below the fixed plate 3. By pushing and drawing the slide case 4 by means of a hydraulic or electrical actuator 7, a nozzle hole 3*a* of the fixed plate 3 and a nozzle hole 5*a* of the slide plate 5 are caused to match or mismatch with each other. As a result, control is performed for an outflow of a molten metal which flows downward from the molten metal vessel 1 through an insertion nozzle 8.

As illustrated in FIGS. 12 and 13, the slide case 4 is biased upward by using springs 12 through a pressing means in which rollers (movable bodies) 14 sliding on a support surface 13 are used, and the slide plate 5 is brought into contact with the fixed plate 3 with a predetermined pressing force. As a result, leakage of a molten metal and intrusion of air through the respective nozzle holes 3*a* and 5*a* of the fixed plate 3 and the slide plate 5 may be prevented. Further, as illustrated in FIG. 14, the slide case 4 having the rollers 14 is openable and closable through an intermediation of an axial support portion 15, and hence replacement of a fireproof material may be performed.

The pressing means in the slide valve device having a similar basic structure as described in the above structure is disclosed in JP 01-38592 B, for example.

Further, in the sliding nozzle device provided with a surface pressure application/release mechanism disclosed in JP 06-226430 A (not shown), application and release of the surface pressure to the elastic means may be achieved through a movement of the pressing member, and the application and release of the surface pressure and the opening/closing operation of the flow path may be achieved by means of independent driving mechanism.

SUMMARY OF THE INVENTION

1. Problems to be Solved by the Invention

The conventional slide valve devices are structured as described above, and hence the following problems are present.

That is, in a first conventional structure in which the toggle mechanism described above is used, the surface pressure is manually applied and released. Therefore, the operation is highly heavy physical work to be conducted under high temperature.

Further, in a second conventional structure disclosed in the specification of Japanese Patent Application No. 2004-327405 described above, the surface pressure may easily be applied and released by means of a cylinder drive. However, owing to a two-layer structure, it is structurally impossible to apply three-layer structure thereto. In addition, surplus sliding strokes are required for releasing the surface pressure, and hence the lengths of the device main body and the cylinder are increased. As a result, the device main body and the cylinder are increased in size.

Still further, also, a third conventional structure disclosed in JP 01-38592 described above is difficult to be applied to the three-layer structure. As a result, similarly to the second conventional structure, a shape thereof becomes larger and the structure thereof becomes complicate.

Yet further, also, in a fourth conventional structure disclosed in JP 06-226430 described above, the structure thereof is extremely complicated because the pressing members are necessary to turn, and the toggle arms, etc. are required.

2. Means for Solving the Problem

A slide valve device for automatic surface pressure application according to the present invention includes:

a fixed plate fixed within a base frame firmly adhering to a bottom lower surface of a molten metal vessel;

a slide case slidably provided below the fixed plate by means of an actuator and having a slide plate;

a seal case provided below the slide case and having a seal plate and/or a shooting nozzle;

a movable body provided to each side portion of the seal case so as to be movable on a support surface; and a coupling means for coupling the slide case with the seal case, in which the guide piece and the seal case are slid by means of the actuator in a state of being coupled with each other through an intermediation of the coupling means so that the surface pressure can be applied and released.

Further, the coupling means includes a connecting pin or a coupling stopper obtained through integrating the connecting pin with a stopper.

Still further, an attachment/detachment position of the coupling means for coupling the guide piece and the seal case is set to a fully opened position or a fully closed position of the slide case upon a use stroke thereof.

Yet further, the seal case or the stopper provided on the base frame or the coupling stopper is pivotably provided; and a heat insulating cover pivotably provided on a side of the fixed plate can be closed only when the stopper is accommodated at a horizontal position.

3. Effects of the Invention

The slide valve device for automatic surface pressure application according to the present invention is structured as follows, and hence the following effects can be obtained.

That is, in the three-layer structure constituted by the fixed plate, the slide plate, and the seal plate, only the slide plate is slid so as to perform control and an ON/OFF operation of the flow of hot water, and the seal case and the slide case are coupled with each other by means of the coupling means so as to be slid. The surface pressure is applied and released by means of the movable bodies such as rollers sliding on the support surface, whereby the configuration can be downsized and simplified.

Further, owing to the above-mentioned effect, the heavy physical work conducted under high temperature is eliminated, whereby operability can be significantly increased.

DETAILED DESCRIPTION OF THE INVENTION

It is an object of the present invention to provide a slide valve device for automatic surface pressure application in which a seal case is slid by means of movable bodies such as rollers in the three-layer structure constituted by a fixed plate, a slide plate, and a seal plate so as to eliminate heavy physical work conducted under high temperature and to achieve compactification.

In the following, a slide valve device for automatic surface pressure application according to a preferred embodiment of the present invention is described with reference to the drawings.

Note that, the same or similar parts as those in the conventional example are described while denoted by the same reference symbols.

Figure 1:
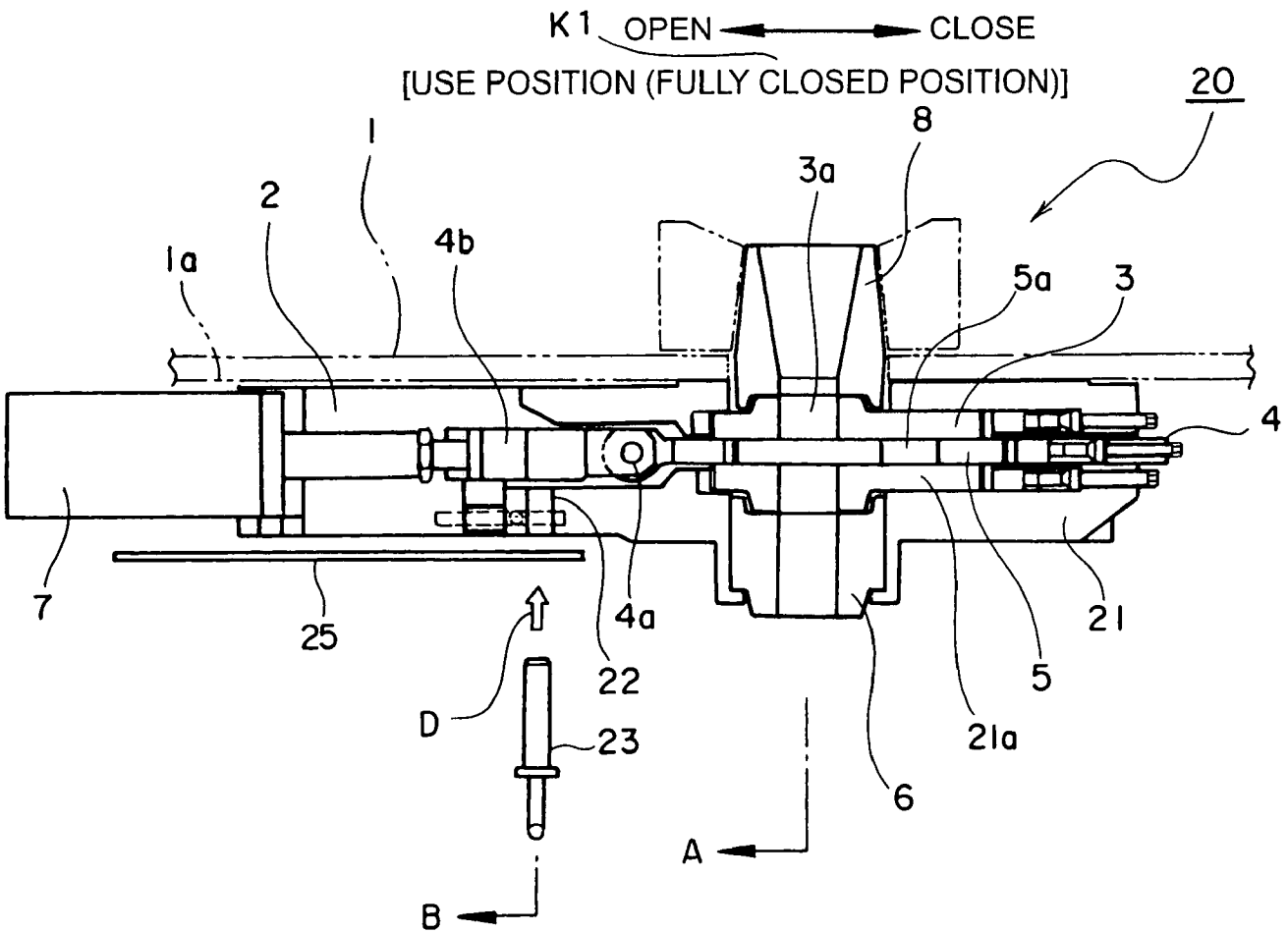
FIG. 1 is a sectional view of a slide valve device for automatic surface pressure application according to the present invention.

FIG. 1 illustrates a state of a use position (fully closed position) of a slide valve device 20. A bottom lower surface 1*a* of a molten metal vessel 1 is provided with a fixed plate 3 having a nozzle hole 3*a* communicating with an insertion nozzle 8 through an intermediation of a base frame 2.

Below the fixed plate 3, a slide case 4 having a slide plate 5 provided with a nozzle hole 5*a* is connected through an intermediation of a guide piece 4*b* to a hydraulic or electrical actuator 7. With the activation of the actuator 7, only the slide case 4 can be independently slid in a horizontal direction in the drawing.

The slide case 4 can be bent downward in the drawing owing to an axial support portion 4*a* provided on a side of the guide piece 4*b*. A seal case 21 having a seal plate 21*a* below the slide case 4 is similarly openable and closable through an intermediation of an axial support portion 15 while applying the structure illustrated in the conventional structure of FIG. 9. Therefore, the slide case 4 can be bent after the seal case 21 is released.

The guide piece 4*b* and the seal case 21 are formed to be integrally slidable by means of a coupling means 23 such as a connecting pin inserted into a coupling hole 22. In the coupled state, the slide case 4 and the seal case 21 can be slid by means of the actuator 7.

Figure 2:
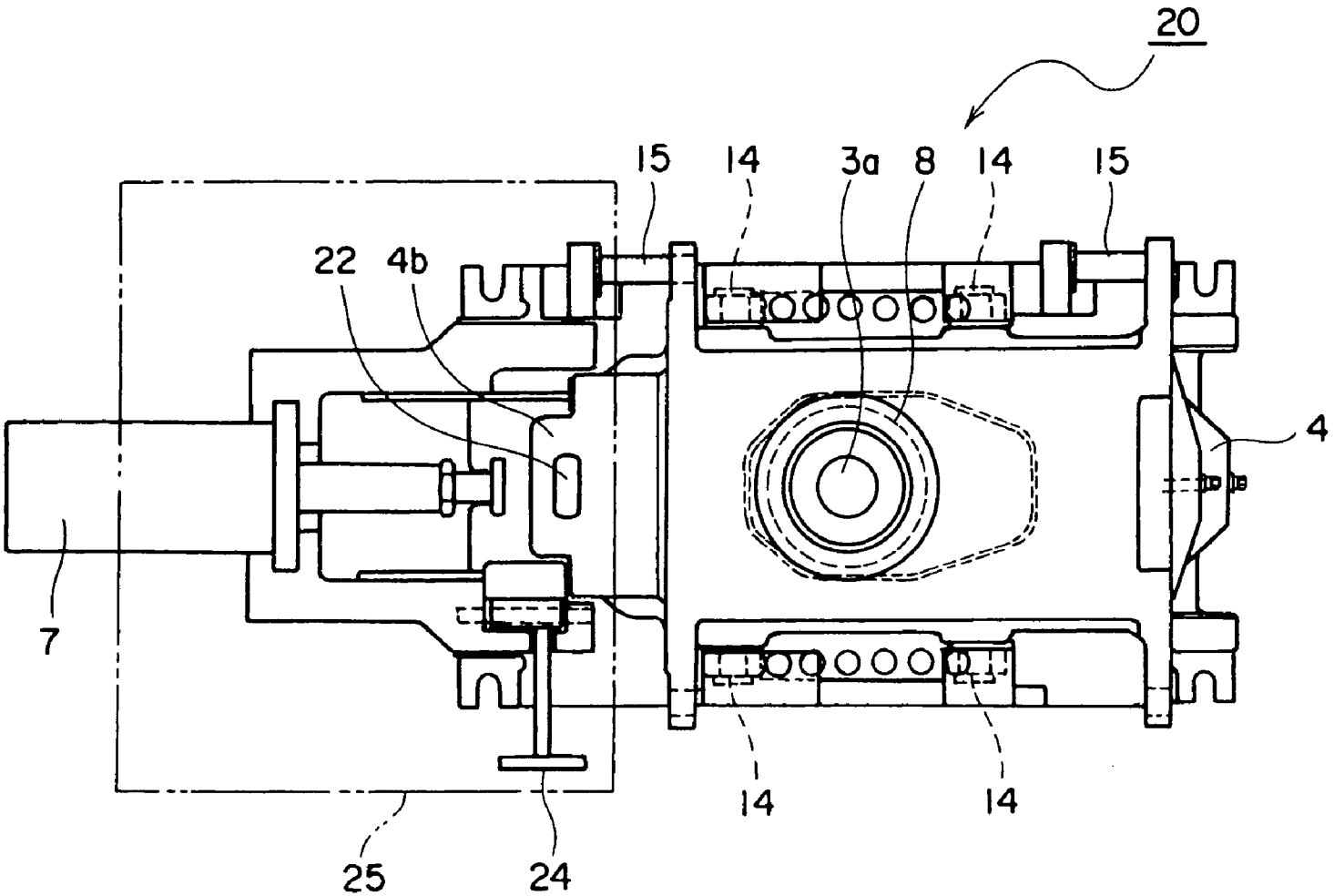
FIG. 2 is a plan view of FIG. 1.
Figure 4:
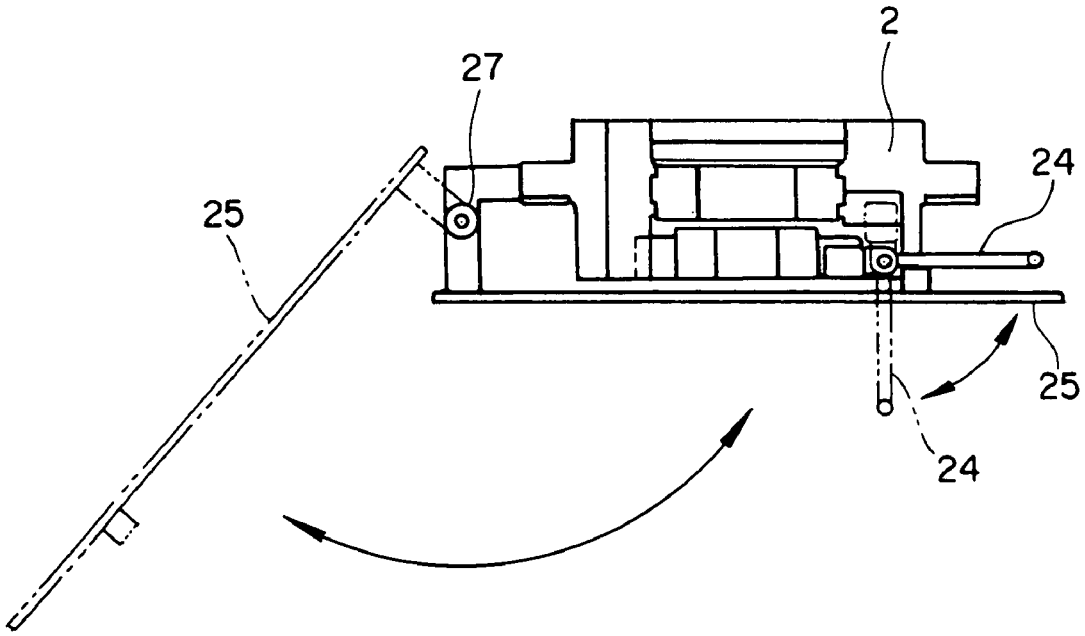
FIG. 4 is a sectional view taken in the arrow B direction of FIG. 1.

FIG. 2 is a plan view of FIG. 1. The seal case 21 is provided with a stopper 24 pivotable only by 90 degrees from a horizontal direction to a vertical direction and vice versa. Below the seal case 21, a plate-like heat insulating cover 25 is provided pivotably toward the base frame 2 through an intermediation of an axial support portion 27 as illustrated in FIG. 4. Note that, the stopper 24 is used for limiting the sliding range of the seal case 21 which comes into contact with protrusions or the like (not shown) during sliding.

Therefore, as illustrated in FIG. 4, the heat insulating cover 25 is allowed to assume a closing state when the stopper 24 is situated at a horizontal position (solid line), and is not allowed to assume the closing state when situated at a vertical position (dotted line).

Figure 3:
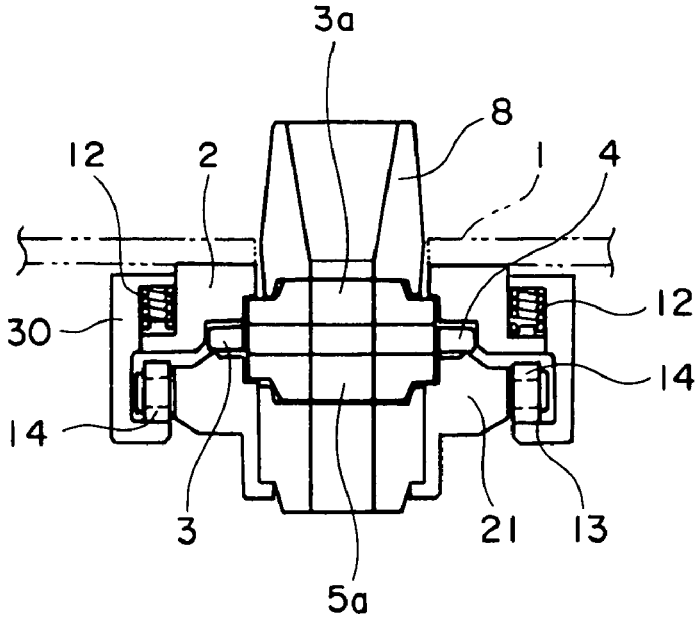
FIG. 3 is a sectional view taken in the arrow A direction of FIG. 1.

FIG. 3 is a sectional view taken in the arrow A direction of FIG. 1. A spring holder 30 is operably held to the base frame 2 through an intermediation of springs 12. The movable body 14 provided on each side of the seal case 21 is held in slidable contact with the support surface 13 formed on the bottom surface of the spring holder 30.

Accordingly, when the movable body 14 moves on the support surface 13 owing to sliding of the seal case 21, the spring holder 30 vertically moves, whereby the surface pressure can be applied and released.

Next, the operation thereof is described. First, in the slide valve device 20 of the present invention, when hot water flows through the insertion nozzle 8, only the slide case 4 is slid by means of the actuator 7, whereby it is possible to perform control and an ON/OFF operation of the hot water which flows from the insertion nozzle 8 into the shooting nozzle 6 through the nozzle holes 3*a* and 5*a*.

Next, in the case where fireproof materials of the portions are replaced after completion of the supply of the hot water as described above, the movable body 14 is detached from the support surface 13 when the seal case 21 and the slide case 4 are slid together in the state of being coupled with each other by means of the coupling means 23. As a result, the surface pressure can be released as described above.

Next, the case where the fireproof materials of the above-mentioned slide valve device 20 are replaced is described. First, the slide case 4 is situated at the fully closed position (K1 of FIGS. 1 and 5), and the stopper 24 is raised after opening of the heat insulating cover 25. Next, the connecting pin 23 is inserted into a hole (not shown) provided to the guide piece 4*b* of the slide case 4 from a side of the seal case 21. In this manner, the seal case 21 and the slide case 4 are integrally coupled with each other.

Figure 5:
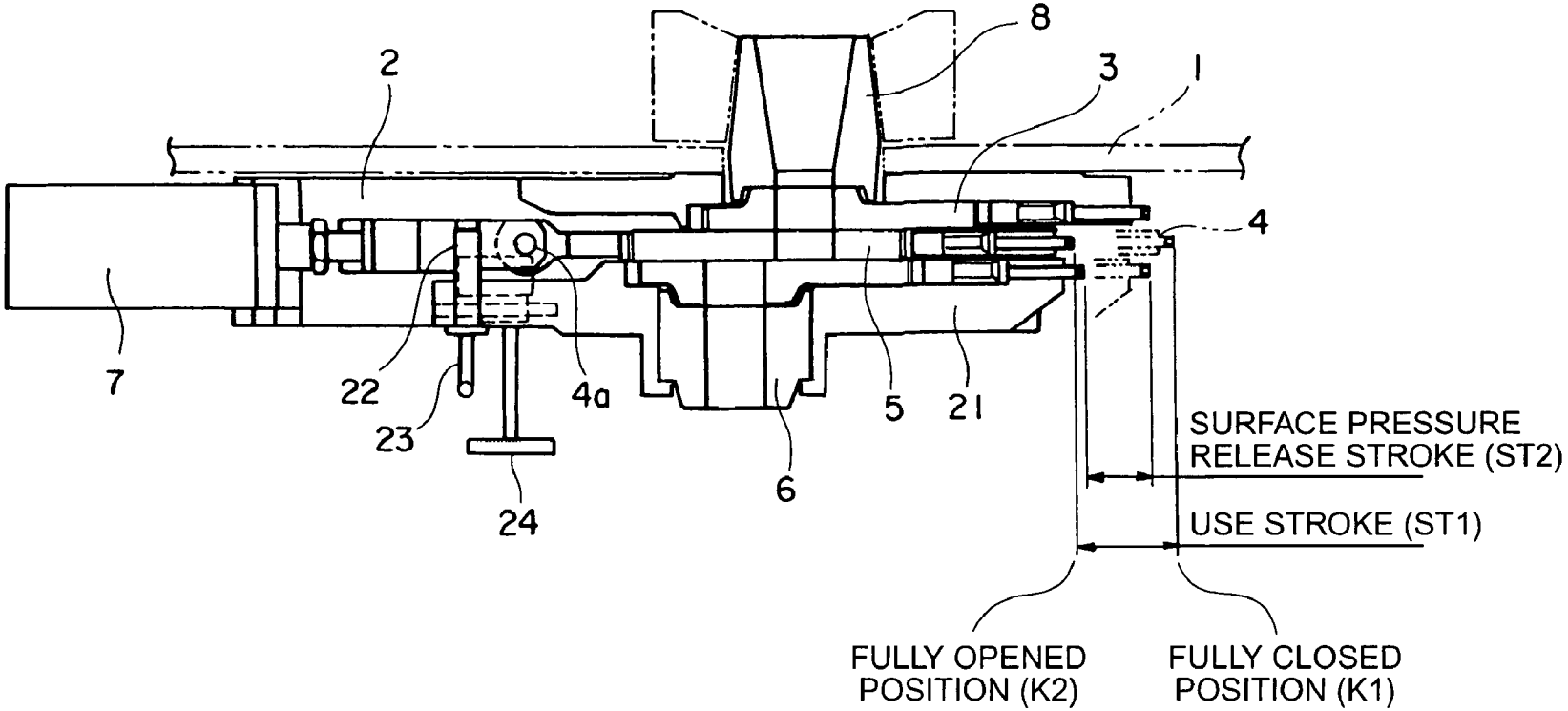
FIG. 5 is a sectional view illustrating release positions of a seal case of FIG. 1.
Figure 6:
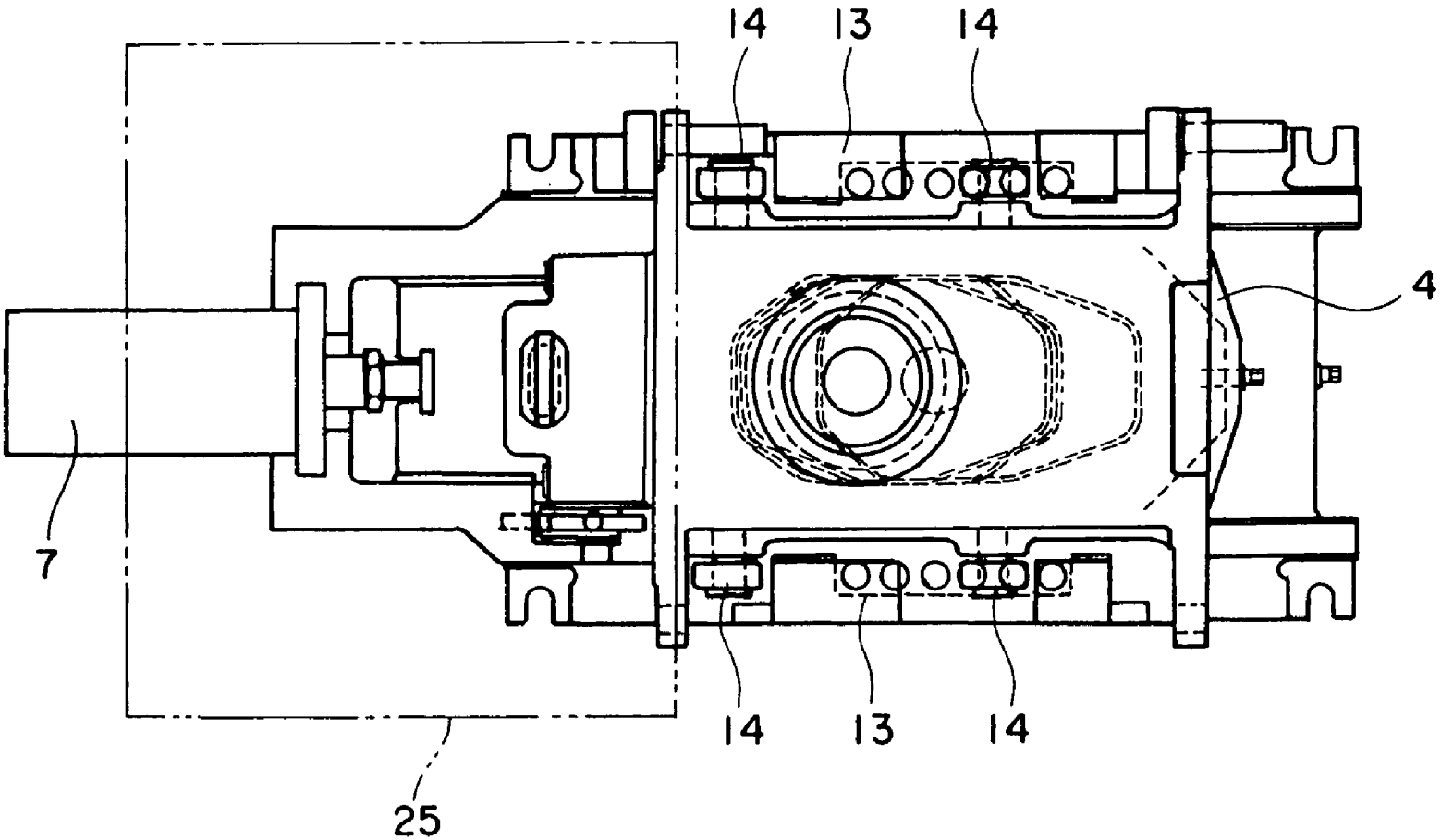
FIG. 6 is a plan view of FIG. 5.
Figure 7:
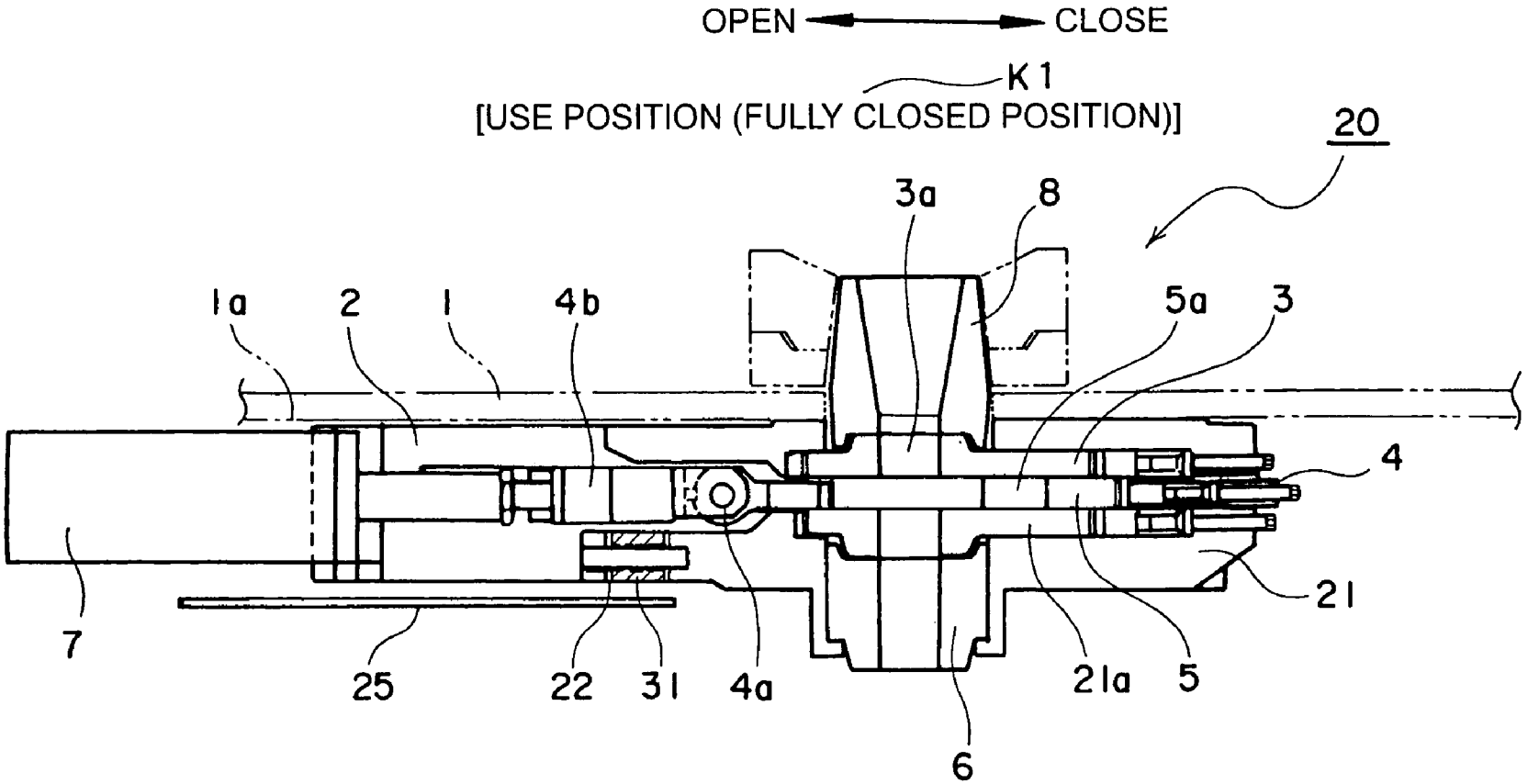
FIG. 7 is a sectional view illustrating another mode of FIG. 1.
Figure 8:
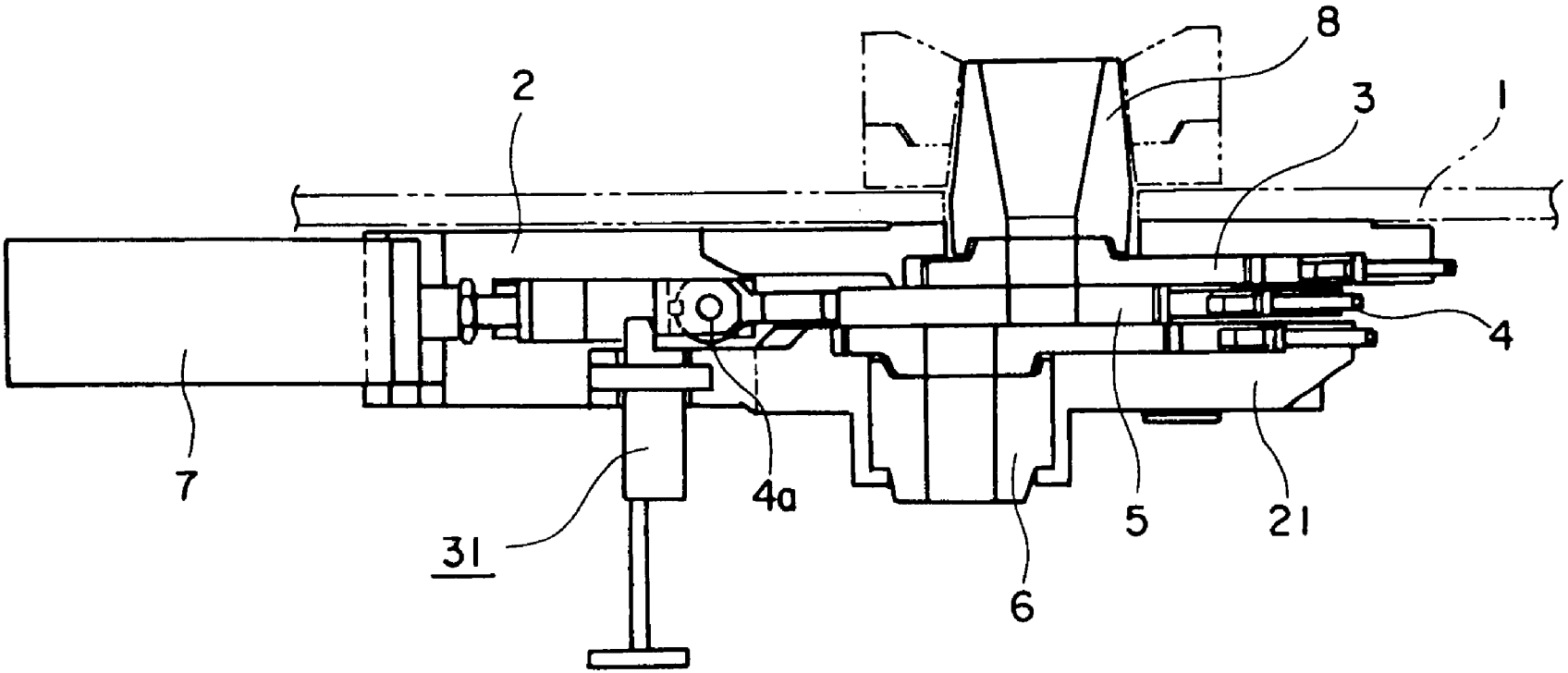
FIG. 8 is a sectional view illustrating another mode of FIG. 5.

Next, in accordance with the movement of the slide case 4 to a fully opened position K2 of FIG. 5, the seal case 21 is drawn by means of the guide piece 4*b* so as to move to the opened side. As a result, the movable body 14 is detached from the support surface 13 of the spring holder 30, whereby the surface pressure applied by means of the springs 12 is released.

Figure 9:
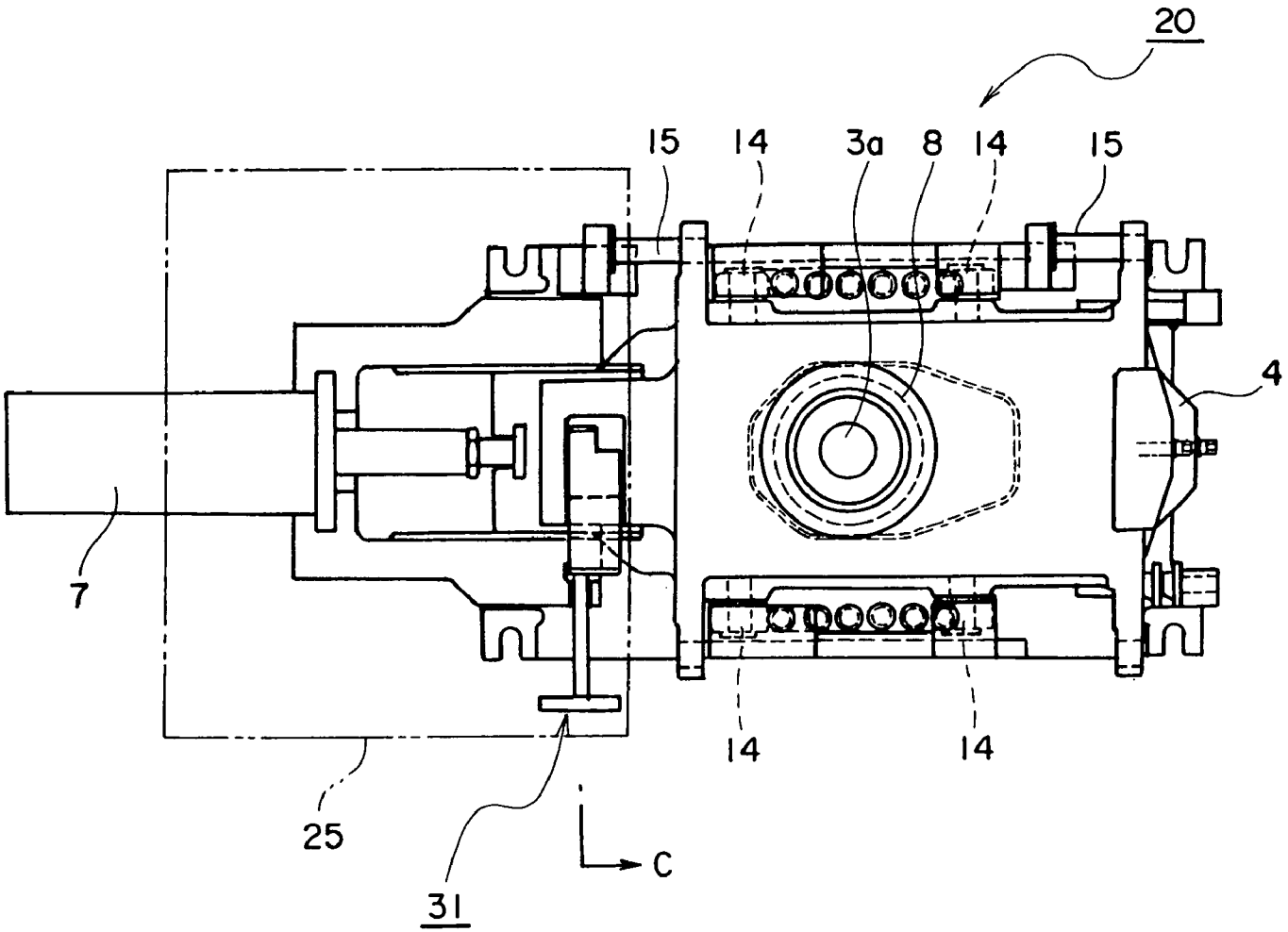
FIG. 9 is a sectional view illustrating another mode of FIG. 2.
Figure 10:
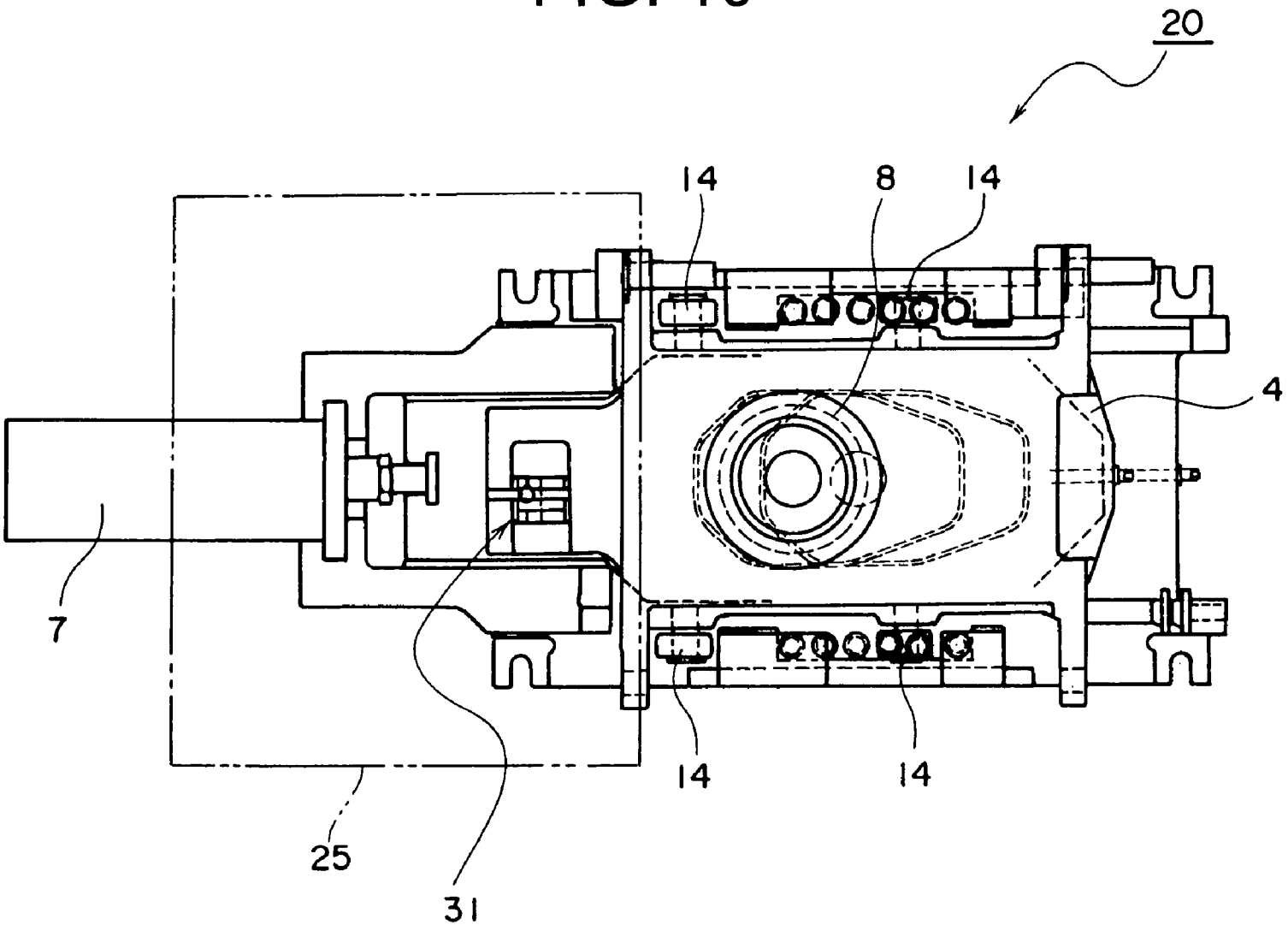
FIG. 10 is a sectional view illustrating another mode of FIG. 6.
Figure 11:
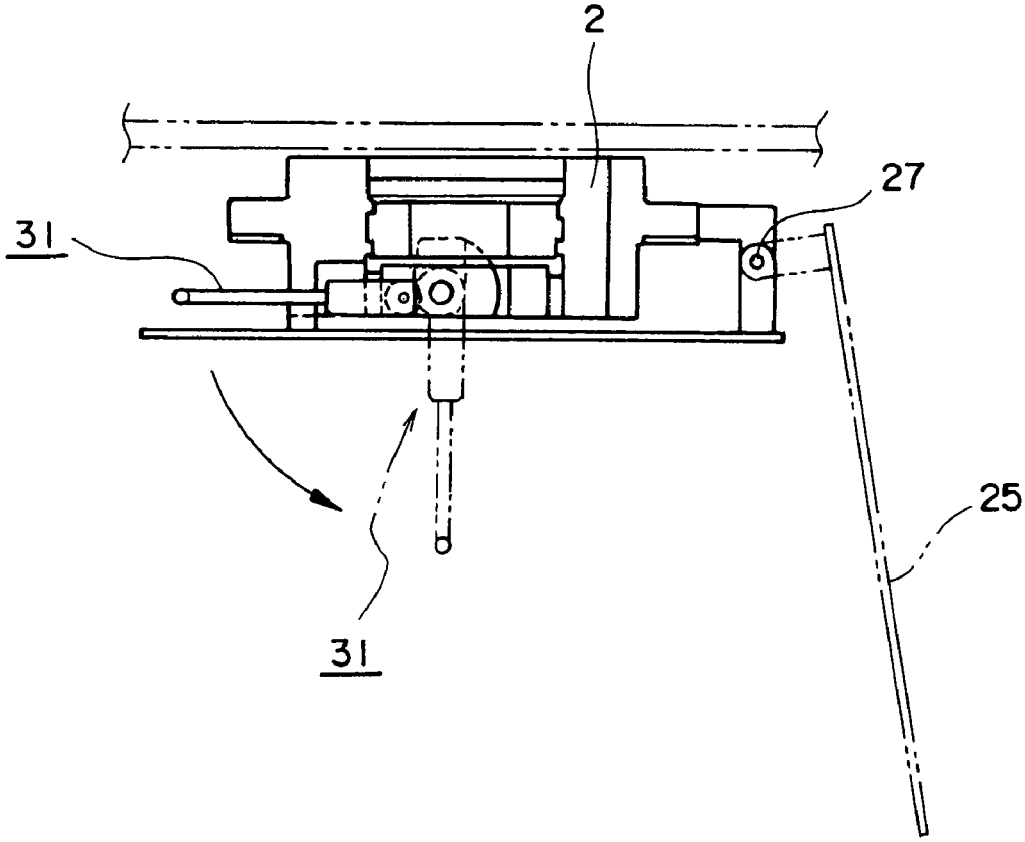
FIG. 11 is a sectional view taken in the arrow C direction of FIG. 9.
Figure 12:
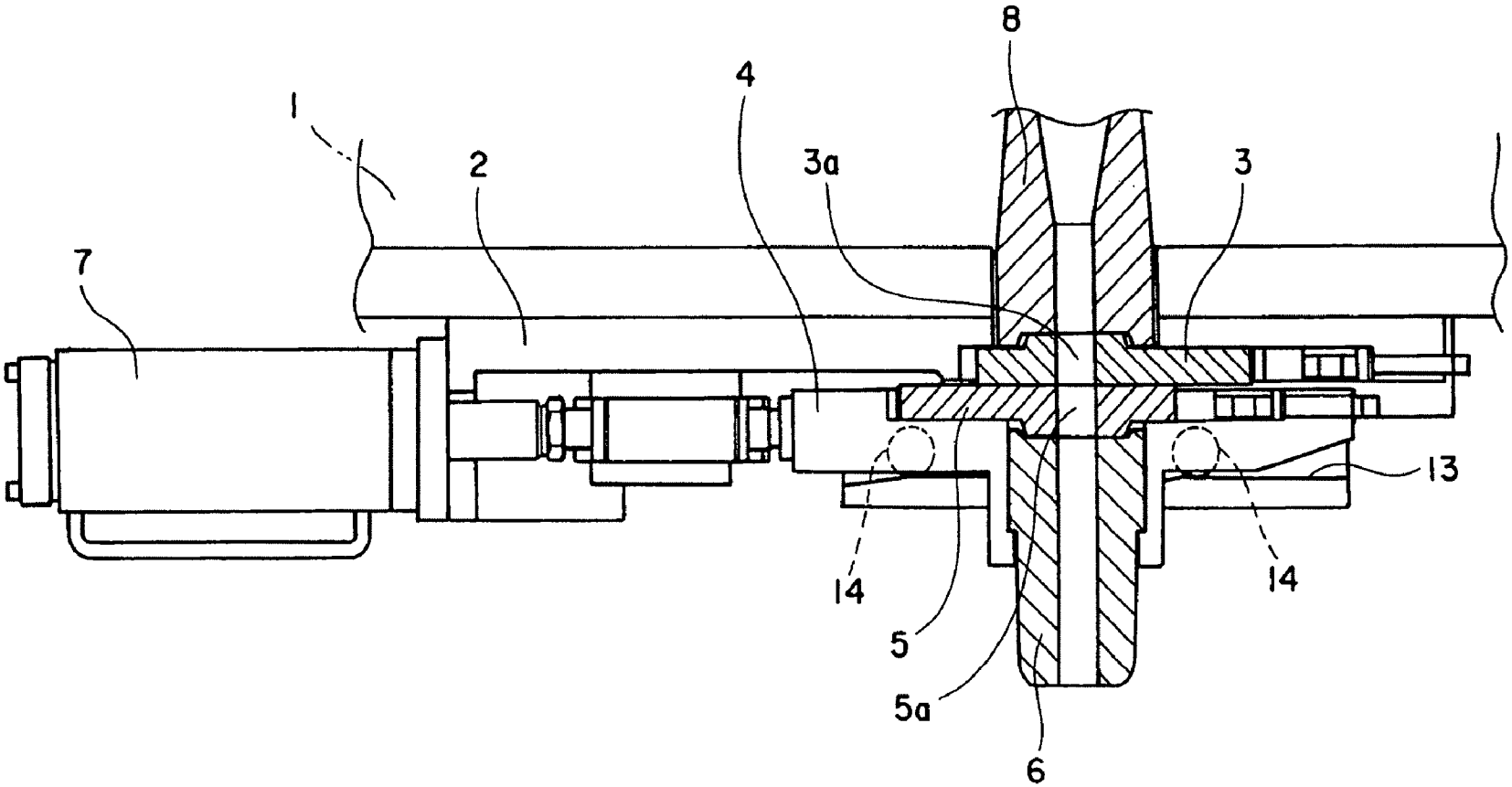
FIG. 12 (PRIOR ART)
FIG. 12 is a sectional view of a conventional slide valve device.
Figure 13:
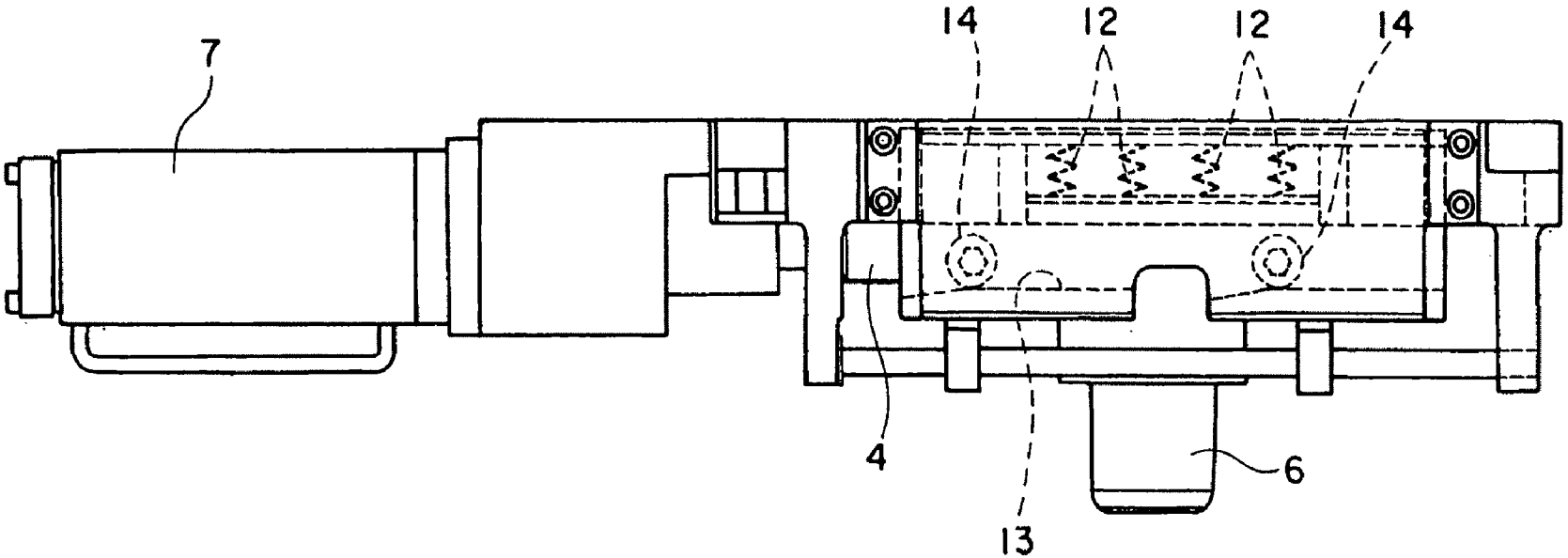
FIG. 13 (PRIOR ART)
FIG. 13 is a structural view of an essential portion of FIG. 12.
Figure 14:
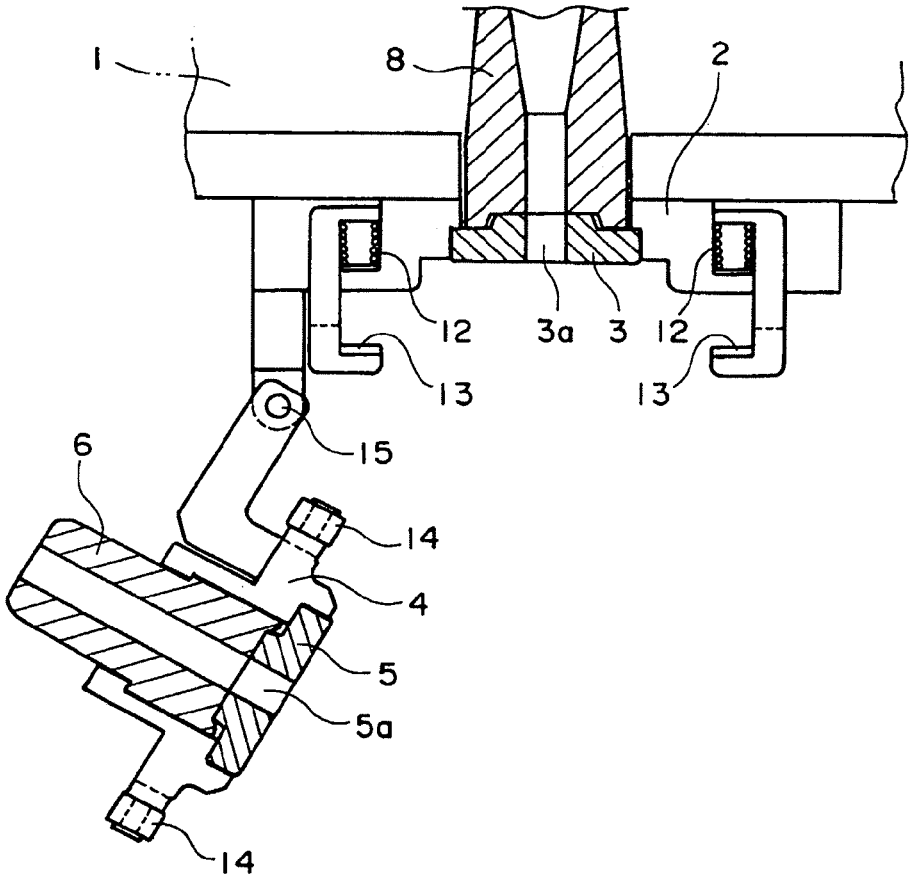
FIG. 14 (PRIOR ART)
FIG. 14 is a sectional view illustrating a release state of the essential portion of FIG. 12.

Next, with the structure similar to the conventional structure illustrated in FIG. 9, the seal case 21 and the slide case 4 are pivoted through the intermediation of the axial support portion 15 so as to be released, whereby it is possible to perform replacement and the like of the fireproof materials of the portions of the slide case 4 and the seal case 21.

Further, after completion of the replacement of the fireproof materials, maintenance, and the like of the portions, the surface pressure is applied by means of procedure opposite to the above-mentioned procedure. In this manner, a maintenance operation is finished, and the slide valve device 20 can be reused for molding.

Note that, as illustrated in FIG. 5, an attachment/detachment position D of the coupling means 23 for coupling the slide case 4 and the seal case 21 is set to be the fully opened position K2 or the fully closed position K1 of a use stroke ST1 upon which only the slide case 4 is caused to be slid for performing an OPENING/CLOSING (ON/OFF) operation of the nozzle. The use stroke ST1 covers a range wider than that of a surface pressure release stroke ST2 which is performed through sliding of the slide case 4 together with the above-mentioned seal case 21 and with which the surface pressure is applied and released.

FIGS. 7 to 11 illustrate other modes of the present invention. The same parts as those in FIGS. 1 to 6 are denoted by the same reference symbols, and only the parts different therefrom are described. That is, while the connecting pin 23 and the stopper 24 serving as coupling means are separated from each other in the modes of FIGS. 1 to 6, the connecting pin 23 and the stopper 24 are integrated with each other so as to form a coupling stopper 31 of integrated type in the modes of FIGS. 7 to 11. As a result, the stopper 24 is rotatably supported with respect to the connecting pin 23 in a bendable manner.

Therefore, the coupling stopper 31 obtains the same coupling operation as that of the connecting pin 23 by being inserted into the coupling hole 22, and obtains the same stopper operation as that of the stopper 24 by bending the stopper 24.

The invention claimed is:

1. A slide valve device for automatic surface pressure application, comprising:

a fixed plate (3) fixed within a base frame (2) firmly adhering to a bottom lower surface (1*a*) of a molten metal vessel (1);

a slide case (4) having a slide plate (5) slidably provided by means of an actuator (7) below the fixed plate (3);

a seal case (21) provided below the slide case (4) and having a seal plate (21*a*) and/or a shooting nozzle (6);

a movable body (14) provided to each side portion of the seal case (21) so as to be movable on a support surface (13); and a coupling means (23) for coupling a guide piece (4*b*) coupled with the slide case (4) with the seal case (21), wherein the guide piece (4*b*) and the seal case (21) are slid by means of the actuator (7) in a state of being coupled with each other through an intermediation of the coupling means (23) so that the surface pressure can be applied and released.

2. A slide valve device for automatic surface pressure application according to claim 1, wherein the coupling means (23) comprises a connecting pin.

3. A slide valve device for automatic surface pressure application according to claim 1, wherein an attachment/detachment position (D) of the coupling means (23) for coupling the slide case (4) and the seal case (21) is set to a fully opened position (K2) or a fully closed position (K1) of the slide case (4) upon a use stroke (ST1) thereof.

4. A slide valve device for automatic surface pressure application according to claim 1, wherein:

the seal case (21) or base frame (2) is provided with a pivotable stopper (24); and a heat insulating cover (25) pivotably provided on a side of the fixed plate (3) can be closed only when the stopper (24) is accommodated at a horizontal position.

5. A slide valve device for automatic surface pressure application according to claim 1, wherein:

the coupling means (23) and the stopper (24) are integrally formed with each other so as to form a coupling stopper (31);

the coupling stopper (31) effects coupling and a stopper operation.

6. A slide valve device for automatic surface pressure application according to claim 2, wherein an attachment/detachment position (D) of the coupling means (23) for coupling the slide case (4) and the seal case (21) is set to a fully opened position (K2) or a fully closed position (K1) of the slide case (4) upon a use stroke (ST1) thereof.

7. A slide valve device for automatic surface pressure application according to claim 2, wherein:

the seal case (21) or base frame (2) is provided with a pivotable stopper (24); and a heat insulating cover (25) pivotably provided on a side of the fixed plate (3) can be closed only when the stopper (24) is accommodated at a horizontal position.

8. A slide valve device for automatic surface pressure application according to claim 3, wherein:

the seal case (21) or base frame (2) is provided with a pivotable stopper (24); and a heat insulating cover (25) pivotably provided on a side of the fixed plate (3) can be closed only when the stopper (24) is accommodated at a horizontal position.

* * * * *